United States Patent [19]

Green et al.

[11] 3,934,751

[45] Jan. 27, 1976

[54] SAFETY OVERCAP FOR DISPENSING CONTAINERS

[76] Inventors: Edward H. Green; Edward H. Green, Jr., both of 57 Interstate Road, Addison, Ill. 60101

[22] Filed: Dec. 20, 1974

[21] Appl. No.: 535,097

Related U.S. Application Data

[63] Continuation-in-part of Ser. No. 498,440, Aug. 19, 1974, which is a continuation of Ser. No. 352,555, April 19, 1973, abandoned, which is a continuation-in-part of Ser. No. 254,191, May 17, 1972, abandoned.

[52] U.S. Cl. ..... 220/306; 215/9; 215/201; 222/153; 222/182; 220/85 P

[51] Int. Cl.[2] .. B67B 5/00; B65D 55/02; B67D 5/32

[58] Field of Search ..... 220/85 P, 306, 315, 324, 220/326, 352; 215/9, 201–225

[56] References Cited

UNITED STATES PATENTS

| | | | |
|---|---|---|---|
| 2,147,768 | 2/1939 | Des Roches | 220/306 |
| 2,884,160 | 4/1959 | Anplanalp | 220/306 |
| 3,460,708 | 8/1969 | Vollers | 220/85 P |
| 3,532,249 | 10/1970 | Gach | 220/306 |
| 3,633,789 | 1/1972 | Markowitz | 215/9 |
| 3,706,401 | 12/1972 | Gach | 220/85 P |
| 3,738,536 | 6/1973 | Gach | 215/9 |
| 3,773,227 | 11/1973 | Laing | 215/201 |
| 3,820,683 | 6/1974 | Jasinski | 220/306 |
| 3,863,814 | 2/1975 | Shelton | 222/153 |

*Primary Examiner*—George E. Lowrance
*Attorney, Agent, or Firm*—Perry Carvellas

[57] ABSTRACT

An overcap for use with aerosol dispensing containers including a top member having a skirt extending from the peripheral edge thereof, a resilient and flexible central portion, a plurality of arms extending downwardly from the central portion carrying inwardly turned lips at the ends thereof and web means connecting the arms to the peripheral portion of the overcap. When mounted on the aerosol dispensing container the inwardly turned lips engage a protruding rim of the cup member portion of the container, and upon depressing the central portion of the top member, the arms are pivotally moved outwardly to release the container and permit removal of the overcap therefrom.

18 Claims, 11 Drawing Figures

SAFETY OVERCAP FOR DISPENSING CONTAINERS

BACKGROUND OF THE INVENTION

This application is a continuation-in-part of copending application Ser. No. 498,440, filed Aug. 19, 1974 which is a continuation of application Ser. No. 352,555, filed Apr. 19, 1973 now abandoned which is a continuation-in-part of application Ser. No. 254,191, filed May 17, 1972, now abandoned all three in the names of Edward Howard Green and Edward Howard Green, Jr.

FIELD OF THE INVENTION

The present invention pertains to overcaps for containers and, more particularly, to safety overcaps for aerosol containers, which overcaps cannot easily be removed from such containers by children or those not instructed in the method of removing the overcaps.

DISCUSSION OF THE PRIOR ART

In recent years many products of widely varying natures have been packaged in aerosol containers due primarily to the ease with which the products can be dispensed. Such dispensing normally requiring only the depressing of a sprayhead or other dispensing device which opens a valve to dispense the product under the influence of pressure within the container. In order to protect the dispensing device and valve assembly from damage, overcaps have been provided for aerosol containers, such overcaps covering the dispensing device and requiring removal prior to use of the aerosol containers.

The convenience and ease of dispensing of aerosol containers present problems with respect to the packaging of potentially harmful products, such as paints and adhesives, and with respect to unauthorized dispensing of products to determine if the valve assembly is in working order or to sample the product stored within the container. These problems are generally related in that both involve unauthorized operation of the dispensing devices of aerosol containers. The problem of preventing dispensing of potentially harmful products by children is particularly acute in that irreparable damage may result. The unauthorized testing of aerosol containers frequently results in a tested container becoming unsalable due to depletion of the product, attendant damage and/or visual signs of prior use rendering the aerosol container unacceptable to subsequent customers.

SUMMARY OF INVENTION

The present invention is specifically directed to a safety overcap for a dispensing container including a top member having an annular portion, a resilient and flexible central portion, a skirt depending from a peripheral edge of the top member, arms depending from the central portion, the arms having at their lower end locking means adapted to engage a protruding rim of the cup member of the container and web means connecting the arms to the outer peripheral portion of the overcap. The arms are connected to the central portion of the top member and are movable away from the center of the overcap with depression of the central portion. The overcap can be removed from the container by depressing the central portion to cause the arms to move away from and the locking means to disengage the rim of the container.

The webs may have any desired configuration. The webs can be generally square, rectangular, triangular or in the form of a quarter circle in shape. The webs can extend one forth the length of arms 56 or can extend the full length of the arms 56. The bottom of the web adjacent the arm 56 can be angled upward to terminate at a point adjacent to the peripheral edge of the top member or can be angled to terminate at the inner wall of the skirt directly opposite. The length of the web is preferably one forth to three forths the length of the arm 56. Where a generally triangular shaped web is used the included angle formed between the arms and the bottom of the web can be 20° to 90° and preferably 30° to 60°. Where the web 58 is in the form of a quarter circle, the curved portion is towards skirt 42.

The force required to remove the overcap, for an overcap of specified material and thickness, can be varied by varying length of the web and/or the angle between the lower portion of the web and the arm 56.

An object of the present invention is to construct an overcap for an aerosol dispensing container which is not easily removed by those uninstructed in the manner of removing the same, to prevent access to a dispensing device enclosed within the overcap by children and to deter unauthorized testing of the aerosol dispensing container.

Another object of the present invention is to provide an overcap having a plurality of equally spaced arms depending from a central portion of the overcap which arms engage a protruding peripheral rim of a dispensing container. The central portion is flexible and resilient. There is a peripheral annular pivot point at the outer edge of the top of the overcap such that downward depression of the central portion of the overcap pivotally moves the locking means outwardly away from the center of the overcap.

Other objects and advantages of the present invention will become apparent from the following description of the preferred embodiment taken in conjunction with the accompanying drawings.

DESCRIPTION OF THE PREFERRED EMBODIMENT

Figure 1:
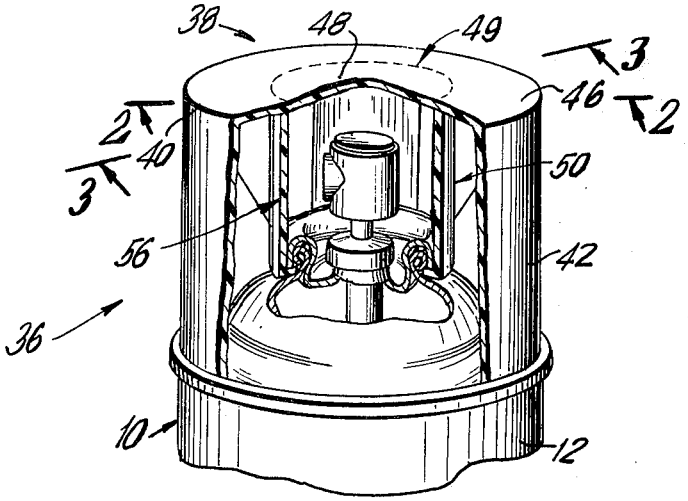
FIG. 1 is a broken perspective view of a safety overcap according to the present invention assembled on an aerosol container.

In the discussion of the figures of the drawings that follows like numbers illustrate like structural features.

The safety overcap of the present invention is discussed with reference to the embodiment illustrated in FIGS. 1 – 5 in combination with an aerosol dispensing container 10; however, while the safety overcap of the present invention is described for use with an aerosol dispensing container, it can be utilized with any suitable dispensing container. The aerosol container 10 is of conventional construction and includes a cylindrical body 12 having an upper edge 14 sealably engaging a peripheral lip 16 of a domed cover member 18. Cover member 18 has an annular recessed base 19 and a shoulder 20 extending from base 19 and terminating at a generally frusto-conical neck 22 which extends inwardly to a central collar 24 defining an aperture in which a mounting cup 26 is disposed. The mounting cup 26 has a protruding rim 28 rolled over collar 24 in a sealed engagement therewith and extending radially outwardly and spaced over shoulder 20 to form an annular recess 30 around neck 22. The peripheral rim 28 terminates in a downwardly facing generally horizontally disposed edge 28a. Neck 22 can have an annular bulge 31 extending therearound within recess 30. Mounting cup 26 supports a valve assembly 32, and a dispensing device, such as a spray nozzel 34, communicates with the valve assembly 32 through a valve stem and extends axially above the aerosol container.

Figure 4:
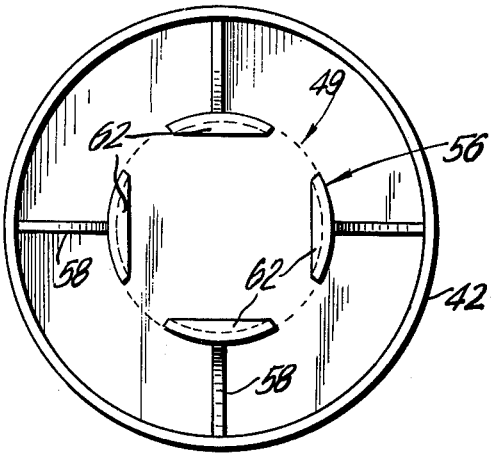
FIg. 4 is a bottom plan view of the safety overcap of FIG. 1.

The safety overcap of the present invention is generally indicated at 36 and includes a top member 38 having a circular peripheral edge 40 from which depends a substantially cylindrical outer skirt 42 having a lower end 44. Top member 38 has an annular portion 46 surrounding a central portion 48. The annular portion 46 can be generally flat. The central portion 48 can be generally flat. The juncture between portions 46 and skirt 42 defines an annular pivot point, at about the peripheral edge 40. The place at which central portion 48 and annular portion 46 meet forms a circular junction 49. The diameter of the circle formed by junction 49 is about the same as the diameter of the outer circumference of rim 28. The arms can comprise four equally spaced curved sections 56, as illustrated in FIG. 4.

The four arms 56 depend from about the circular junction 49 of the top member 38. The sides of arms 56 are spaced from the side edges of adjacent arms 56 so as to be freely movable. Each arm 56 is formed with a web 58. The web 58 can have a generally triangular configuration. The angle formed between the arm 56 and the lower edge of the web 58 is about 45°. The lower portion of arm 56 terminates at an inwardly turned, radially extending locking lip or flange 62 which engages under edge 28a. Web 58 has an upper portion 64 extending radially outward along the undersurface of annular portion 46. The length of upper portion 64 can extend all the way to peripheral edge 40. Web 58 functions to transmit force and movement of central portion 48 and annular portion 46 to withdraw locking lip 62 from beneath rim 28.

The use of the safety overcap 36 with aerosol container 10 will be described with reference to FIG. 2 wherein the safety overcap is illustrated in a storage position on the aerosol container and FIG. 5 wherein the safety overcap is illustrated in a released position just prior to removal of the safety overcap from the aerosol container.

Figure 2:
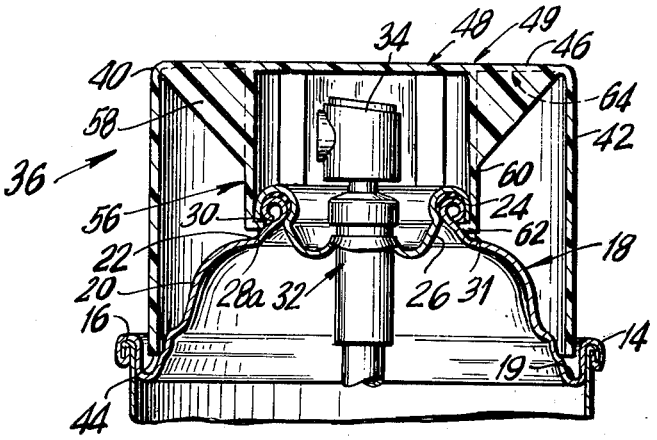
FIG. 2 is a section taken along line 2—2 of FIG. 1.
Figure 3:
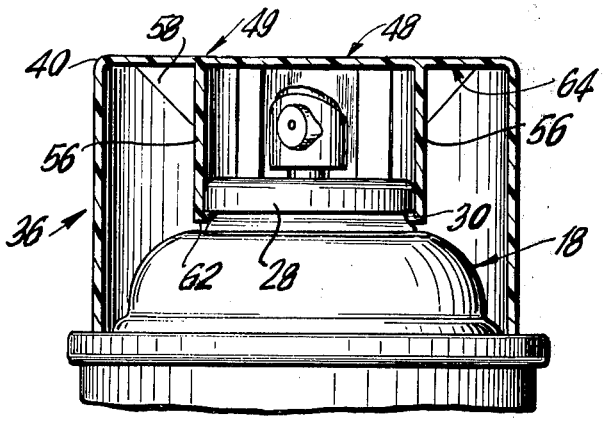
FIG. 3 is a section taken along line 3—3 of FIG. 1.

As shown in FIG. 2, the length of outer skirt 42 is sufficient to extend below lip 16 of cover member 18 and into annular recess base 19 in the storage position. The arms 56 are of such a length that they are spaced above the shoulder 20 of cover member 18. The length of skirt 42, relative to arms 56, is such that when the central portion 48 is depressed and the bottom 44 of skirt 42 is in contact with the cover 18, there is sufficient clearance between the bottom of arms 56 and shoulder 20 to allow locking lip or flange 62 of arms 56 to swing outward. The length of arms 56 is such that inwardly turned lips 62 are received in recess 30 and engage the underside edge 28a of peripheral rim 28 and the bulge 31 extending around neck 22. The dimensions of top member 38, outer skirt 42 and arms 56 are variable in accordance with the dimensions and configuration of the container of which the overcap is to be used. Overcap 36 is held in the storage position with lower end 44 of skirt 42 spaced from cover member 18 due to the resting of locking lips 62 on annular bulge 31.

Alternatively, the annular bulge 31 is omitted and overcap 36 is held in the storage position with bottom end 44 of skirt 42 resting in recess 19 and abutting cover 18 and locking lips 62 engaged to the underside edge 28a of peripheral rim 28.

In the storage position the safety overcap 36 is securely mounted on aerosol container 10 and can be easily removed therefrom only in the prescribed manner. The safety overcap 36 cannot be pried from the container, due to the engagement of locking lips 62 with the downwardly facing generally horizontally disposed edge **28*a* of rim 28 and the extension of the lower end 44 of outer skirt 42 below the lip 16 of the cover member 18.**

Figure 5:
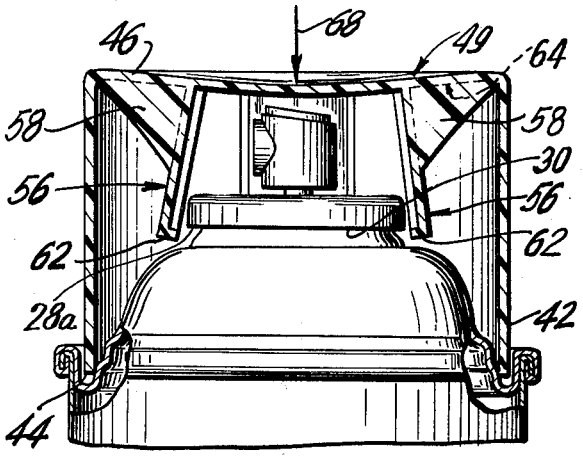
FIG. 5 is a broken view partially in section of the safety overcap of FIG. 1 depressed for removal from the aerosol container.

The procedure for the removal of the overcap is shown in FIG. 5. In order to remove safety cap 36, central portion 48 is depressed by an axially applied force as indicated by arrow 68. The force for depressing central portion 48 may be simply applied by grasping the overcap with one hand with the forefinger applying pressure to the central portion. The central portion 48 and annular portion 46 are, in the at rest position, both generally flat. Depression of central portion 48 causes arms 56 to pivot outwardly away from the center of the overcap, to release the container 10 and permit removal of the overcap. The force and movement of central portion 48 and annular portion 46 are transmitted to locking lips 62 through webs 58, in an outwardly directed manner, pulling the arms 56 away from rim 28 due to the pivot-like action of the upper portions 64 of the webs 58 at the peripheral edge 40. That is, arms 56 are pulled away from rim 28 by webs 58 due to the flexible, resilient nature of the material of the overcap as force is applied to central portion 48. The overcap is thus released from interlocking engagement with the aerosol container. As pressure is applied to central portion 48, the movement of the overcap 36 toward the container is limited by abutment of the bottom end 44 of skirt 42 with the annular recessed base 19 of cover member 18. That is, the bottom end 44 acts as a stop to limit downward movement of the overcap. Once central portion 48 is depressed sufficiently to place the overcap in the released position shown in FIG. 5, the overcap is simply removed by lifting the overcap from the container.

Another embodiment of the safety overcap of the present invention is discussed with reference to the FIGS. 6, 7 and 8.

Figure 6:
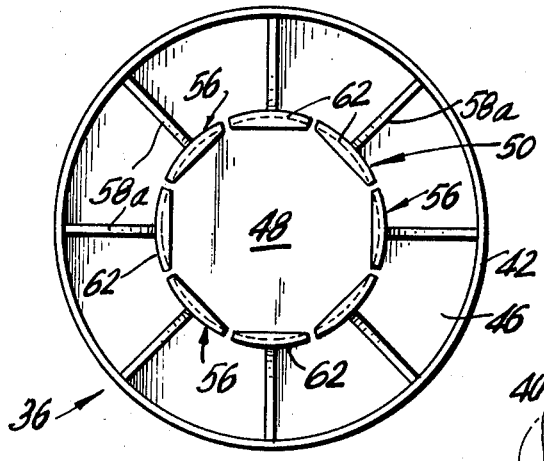
FIG. 6 is a bottom plan view of the overcap of FIG. 7.
Figure 7:
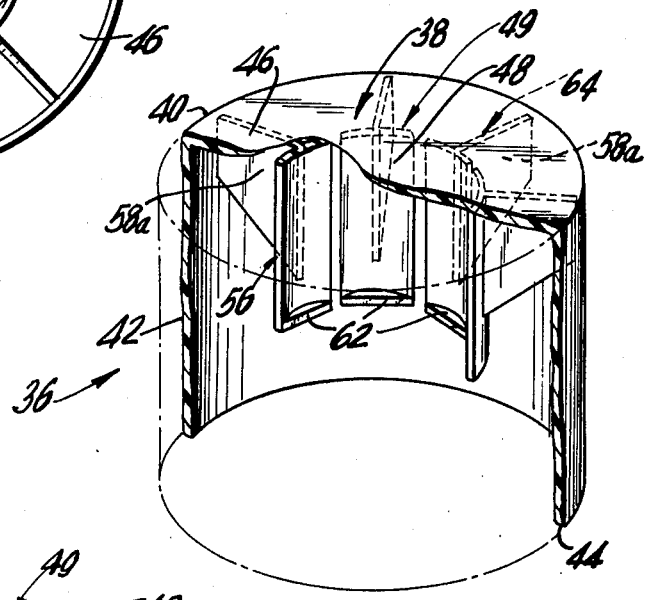
FIG. 7 is a broken perspective view of the safety overcap of FIG. 6.
Figure 8:
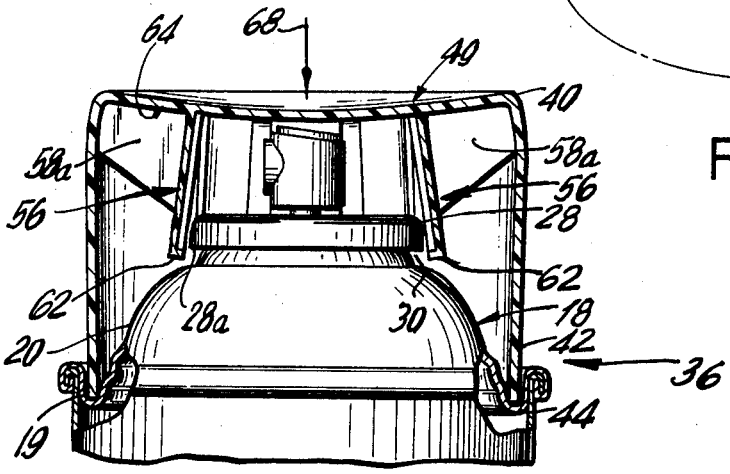
FIG. 8 is a broken view partially in section of the safety overcap of FIG. 7 depressed for removal from the aerosol container.

The overcap illustrated in FIGS. 6, 7 and 8 is similar to that illustrated in FIGS. 1 – 5 and operates in substantially the same manner as previously described.

The safety overcap is generally indicated at 36 and includes a top member having a circular peripheral edge 40 from which depends a substantially cylindrical outer skirt 42 having a lower end 44. Top member has an annular portion 46 surrounding a central portion 48. The annular portion 46 and the central portion 48 can be generally flat, as shown. The junction between annular portion 46 and the peripheral edge 40 defines an annular pivot point. The central portion 48 can be made of more resilient material to increase its ability to stretch slightly, such that the pivotal function of annular pivot point at edge 40 is enhanced. Eight equally spaced arms 56 depend from about the junction 49 of annular portion 46 and central portion 48.

The sides of arms 56 are spaced from each other so as to be freely movable. Each arm 56 is formed with a web 58*a* having a partially triangular configuration. The web 58*a* is about two thirds the length of arm 56. The lower edge of the web, adjacent the lower portion of arm 56, angles upward and outward at about a 45° angle and terminates at the inner wall of the skirt 42. The arms 56 terminate in an inwardly turned, radially extending locking lip or flange 62. In this embodiment locking lip 62 is in the form of a chord of the portion of the arc of the arm 56. Web 58*a* has an upper portion 64 extending radially outwardly along the undersurface of annular portion 46 toward the peripheral edge 40 and the skirt 42. The upper portion of web 58a serves to connect arm 56 to skirt 42. Web 58*a* functions to transmit force and movement of central portion 48 and annular portion 46 to locking lip 62 to pull the arms 56 away from rim 28 and out of the locking position.

The use of the safety overcap 36 with aerosol container 10 will be described with reference to FIG. 6, 7 and FIG. 8. In FIG. 8 the safety overcap is illustrated in a released position just prior to removal of the safety overcap from the aerosol container.

The depression of the central portion 48 of top member 38 causes the arms 56 to deflect outwardly away from the center of the overcap and causes the top member 38 to flex downward and the upper portion of skirt 42 adjacent the webs 58a to slightly flex or stretch outward. Because the overcap is made of flexible, resilient material the replacement of the overcap and the removal of the downward pressure from the central portion 48 will allow the top member 38 and the skirt to flex back to their original shapes and the locking lips 62 to again engage the lower edge 28*a* of rim 28.

The dimensions of top member 38, outer skirt 42 and arms 56 can be varied in accordance with the dimensions and configuration of the container on which the overcap is to be used. As shown in FIG. 8, the length of outer skirt 42 is sufficient to extend below lip 16 and into the annular recessed base 19 of cover member 18. In this embodiment the lower end 44 can be of such length as to be in contact with and abut annular recessed base 19 when in the at rest or storage position. The arms 56 contact the side of peripheral rim 28 with the bottom ends thereof spaced above the shoulder 20 over cover member 18. The length of arms 56 is such that when the central portion is depressed there is sufficient clearance between the bottom of arms 56 and shoulder 20 to allow locking lip or flange 62 of arms 56 to swing outward. The length of arms 56 is such that inwardly turned lips 62 are received under and engage the underside edge 28*a* of peripheral rim 28. Thus, in the storage position safety overcap 36 is securely mounted on aerosol container 10 and can be easily removed therefrom only in the prescribed manner.

Figure 9:
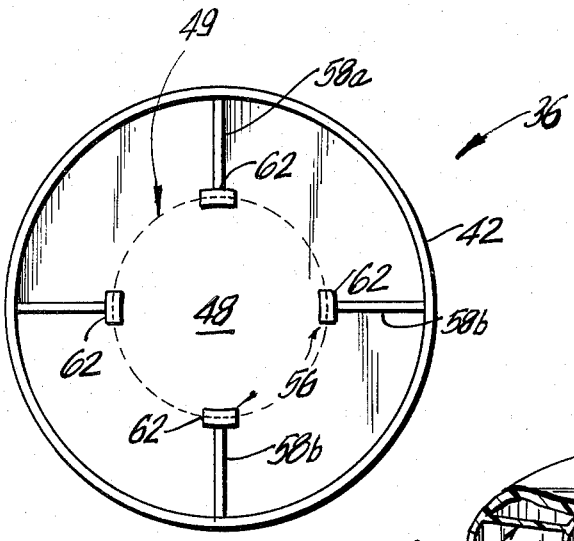
FIG. 9 is a bottom plan view of the overcap of FIG. 10.
Figure 10:
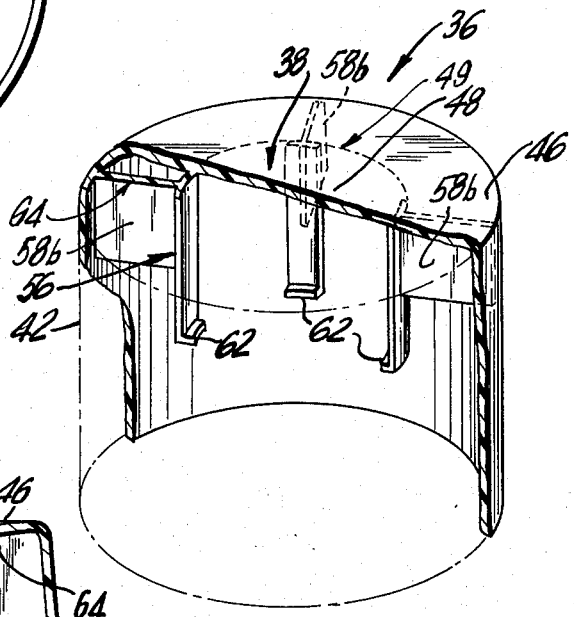
FIG. 10 is a broken perspective view of the safety overcap of FIG. 9.
Figure 11:
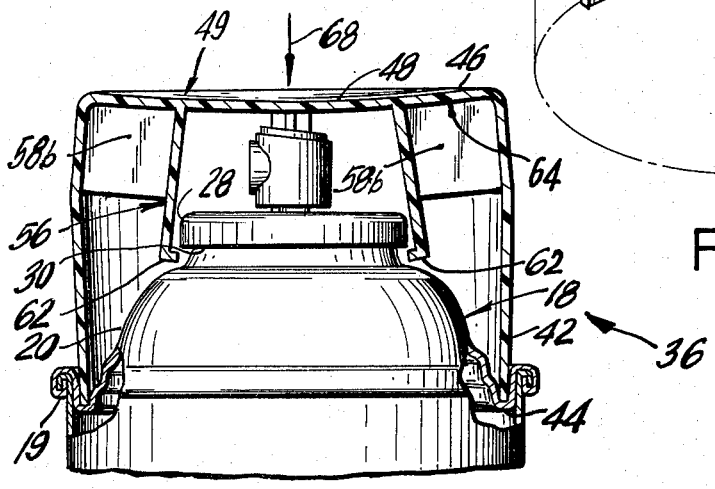
FIG. 11 is a broken view partially in section of the safety overcap of FIG. 10 depressed for removal from the aerosol container.

The safety overcap illustrated in FIGS. 9, 10 and 11 is another embodiment of the present invention.

The safety overcap is generally indicated at 36 and includes a top member 38 having a circular peripheral edge from which depends a substantially cylindrical outer skirt 42 having a lower end 44. Top member 38 has an annular portion 46 surrounding a central portion 48. The annular portion 46 and central portion 48 are generally flat. The junction between portion 46 and skirt 42 defines an annular pivot point at or near edge 40. The place at which central portion 48 and annular portion 46 meet forms a circular junction 49 from which arms 56 depend. Four equally spaced arms 56 depend from junction 49 at about the periphery of central portion 48. The annular portion 46 is made to be about the same thickness as central portion 48. However, in order to improve the flexibility of the annular portion 46, the annular portion 46 can be made of slightly thinner material. Each arm 56 is formed with a web 58b having a generally square configuration. The webs 58b form a connection between arms 56 and skirt 42. The arms terminate at their lower end in an inwardly turned, radially extending locking lip or flange 62. Web 58 *b* has an upper portion 64 extending radially outwardly along the undersurface of central portion 48 toward skirt 42. Web 58*b* is connected to the undersurface of annular portion 46 and skirt 42 and functions to transmit force and movement of central portion 48 to locking lip 62.

The dimensions of top member 38, outer skirt 42 and arms 56 can be variable in accordance with the dimensions and configuration of the container on which the overcap is to be used. As shown in FIG. 11, the length of outer skirt 42 is sufficient to extend below lip 16 of cover member 18. In this embodiment, the lower end 44 can be of such length as to be in contact with and abut annular recess 19 when in the storage position. The arms 56 contact the side of peripheral rim 28 with the bottom ends thereof spaced above the shoulder 20 of cover member 18. The length of arms 56 is such that when the central portion 48 is depressed there is sufficient clearance between the bottom of arms 56 and shoulder 20 to allow locking lip or flange 62 of arms 56 to swing outward. The length of arms 56 is such that inwardly turned lips 62 are received in recess 30 and engage the underside edge 28a of peripheral rim 28.

In order to remove safety cap 36, central portion 48 is depressed by an axially applied force as indicated by arrow 68. The force for depressing central portion 48 may be simply applied by grasping the overcap with one hand with the forefinger applying pressure to the central portion. Depression of central portion 48 causes arms 56 to deflect outwardly away from the center of the overcap and causes the top member 38 to flex downward and the upper portion of skirt 42 adjacent webs 58*b* to flex outward, as shown in FIG. 11, to release the container 10 and permit removal of the overcap. The force and movement of annular portion 46 and central portion 48 is transmitted to locking lips 62 through webs 58*b*, in an outwardly directed manner, due to the pivot-like action of the upper portions 64 of the webs. The pivot point being at or near peripheral edge 40. That is, arms 56 pivot outwardly due to the flexible, resilient nature of the material of the overcap as force is applied to central portion 48 and, thus, the overcap is released from interlocking engagement with the aerosol container.

The safety overcap is preferably integrally constructed of a flexible, resilient plastic material such as polypropylene, polyethylene and the like. A primary requirement in constructing the overcap is in having the top member of the overcap and the outer depending skirt resilient and flexible and/or capable of a slight degree of stretching. This is necessary because the central portion is required to be depressed and flexed downwardly and in some embodiments the upper portion of the outer skirt has to be flexed outwardly a slight degree to release the overcap.

While the specific embodiment of the safety overcap of the present invention as described above and shown in the drawings is extremely advantageous due to its simplicity in structure and function, the configuration of the overcap may be modified within the basic concept of the present invention. There may be any desired number of locking arms and the locking arms can take the form of a two to eight or more equally spaced members. Preferably four equally spaced arms are used.

From the above it will be appreciated that in order to remove the overcap of the present invention from an aerosol container one must realize that the central portion must be depressed; and, without this realization, the overcap cannot be easily removed from the container. Thus, the overcap of the present invention is an extremely effective means of preventing access to dispensing containers by children and further is a deterrent to tampering or unauthorized testing of containers by those not knowing the prescribed manner in which the overcap must be removed. This is particularly true since the generally flat construction of the top of the overcap makes the overcap similar in outward appearance to conventional overcaps. This construction gives no hint of how the overcap is removed. Though it is preferred to have the top member generally flat, it can also be made of a slightly concave or convex configuration. The thickness of the material of the overcap, particularly the flexible, resilient central portion 48 and the annular portion 46 may be varied dependent on the desired force required to deflect the locking arms away from the center of the overcap to release the container. For example, the thickness of the material which forms annular portion 46 may be decreased relative to the central portion 48 so as to provide greater flexibility such that the pivotal function of annular pivot point near edge 40 is enhanced.

Inasmuch as the present invention is subject to many variations, modifications and changes in detail, it is intended that all matter described above or shown in the accompanying drawings be interpreted as illustrative and not in a limiting sense.

What is claimed is:

1. A safety overcap for a dispensing container having a cup member supporting dispensing means for dispensing a product stored in the container and including a protruding rim, said overcap comprising a top member have a flexible central portion, an annular portion and a peripheral edge;

a skirt depending from said peripheral edge of said top member; and a plurality of spaced arms depending from said top member internally of said skirt, the lower portion of said arms having locking means, including an inwardly extending end portion for engaging the rim of the cup member of the container;

each of said arms including a web portion extending radially outwardly from said arms towards said skirt; and said arms being connected with said central portion and said annular portion of said top member of said overcap to be movable away from the center of said overcap with depression of said central portion of said top member.

2. The safety overcap of claim 1 in which each of said arms carries an inwardly turned lip for engaging the rim of the cup member of the container.

3. The safety overcap as recited in claim 1 wherein said central portion of said top member has an external flat configuration and said web portion of each of said arms connects with said annular portion at a position outwardly spaced from said central portion.

4. The safety overcap as recited in claim 1 wherein said overcap is integrally formed of a flexible, resilient material.

5. The safety overcap as recited in claim 1 wherein there are four arms spaced at 90° intervals.

6. The safety overcap as recited in claim 1 wherein the top member, including the central portion and annular portion, is generally flat.

7. The safety overcap as recited in claim 1 wherein said top member includes a flat portion extending around said central portion and said central portion comprises a flexible resilient material.

8. The safety overcap of claim 1 wherein the annular portion of the top member between the skirt and the central portion is of lesser thickness than the central portion.

9. The safety overcap of claim 1 wherein a pivot point is defined at the juncture of the peripheral edge of the top member and the skirt.

10. A safety overcap for a dispensing container comprising a top member having a flexible central and flexible annular portion and a peripheral edge;

a skirt depending from said peripheral edge of said top member;

a plurality of spaced arms depending from said top member, said arms including locking means at the lower end thereof;

web means connected to said arms, said web means extending radially outward toward the peripheral edge of said overcap, said web means connecting the arms to the underside of said annular portion of said top member and to the skirt whereby flexing of said central portion and annular portion of said top member moves said web means and arms outwardly away from the center of said overcap.

11. The safety overcap as recited in claim 10 wherein said locking means includes a plurality of spaced inwardly turned lips.

12. The safety overcap as recited in claim 10 wherein said web means includes a plurality of equally spaced webs, each of said webs having a generally triangular configuration and connected with one of said depending arms.

13. The safety overcap of claim 10 wherein said web means includes a plurality of equally spaced webs, each of said webs having a generally square configuration and connecting one of said depending arms to said skirt.

14. A safety overcap for a dispensing container comprising a top member having a flexible central and annular portion and a peripheral edge;

a skirt depending from said peripheral edge of said top member; and a plurality of spaced arms depending from said central portion of said top member internally of said skirt, the lower portion of said arms having locking means including inwardly turned lips, each of said arms including a web portion extending radially outwardly from said arms towards said skirt;

said web means being connected to the underside of said annular portion and said skirt;

said central portion and said annular portion of said top member having a configuration whereby depressing said central portion and annular portion moves said arms and locking means outwardly away from the center of said overcap.

15. The safety overcap of claim 14 wherein a pivot point is defined at the juncture of the peripheral edge of the top member and the skirt.

16. In combination, an aerosol dispensing container including a cylindrical body, a cup member having a protruding rim, and dispensing means supported by and extending axially from said cup member; and a safety overcap mounted on said aerosol dispensing container including a top member, a flexible central portion an annular portion and a peripheral edge, an outer skirt depending from said peripheral edge of said top member, and a plurality of spaced arms depending from said central portion of said top member, said arms having at the lower ends thereof locking means having inwardly turned lips engaging said protruding rim of said cup member, each of said arms including a web portion extending radially outward from said arms towards said skirt, said arms and webs being connected to said top member at a position radially outwardly displaced from said central portion whereby said overcap can be removed from said aerosol dispensing container by depressing said central portion of said top member to disengage said locking means from said protruding rim.

17. The combination as recited in claim 16 wherein said aerosol container includes a domed cover member having a shoulder, and a neck extending from said shoulder to the protruding rim of the cup member, said protruding rim extending over said shoulder to define an annular recess receiving said inwardly turned lip means.

18. The combination as recited in claim 17 wherein said neck has an annular bulge extending therearound, said inwardly turned lip means being supported on said annular bulge and said skirt having a lower end spaced from said domed member.

* * * * *